US005947035A

United States Patent [19]

Chang

[11] Patent Number: 5,947,035

[45] Date of Patent: Sep. 7, 1999

[54] DEVICE FOR CONNECTING AN AUXILIARY DESK TO A MAIN DESK

[76] Inventor: Chien-Kuo Chang, Fl. 10-2, No. 447, Sec. 3, Wen-Hsin, Taichung, Taiwan

[21] Appl. No.: 09/192,364

[22] Filed: Nov. 16, 1998

[51] Int. Cl.[6] ..... A47B 57/00

[52] U.S. Cl. ..... 108/94; 108/143; 312/322

[58] Field of Search ..... 108/92, 93, 94, 108/139, 140, 143; 312/195, 322, 334.23, 334.26; 248/298.1

[56] References Cited

U.S. PATENT DOCUMENTS 4,387,650 6/1983 Pizzi ..... 108/93 X
5,632,540 5/1997 Wilcox ..... 108/94 X
5,683,154 11/1997 Chang ..... 312/194
5,743,603 4/1998 Kelley et al. ..... 312/195

*Primary Examiner*—Janet M. Wilkens
*Assistant Examiner*—Karlena D. Schwing
*Attorney, Agent, or Firm*—Rosenberg,Klein & Bilker

[57] ABSTRACT

A device for connecting an auxiliary desk to a main desk includes two frames attached to the underside of the main desk and each of the two frames having a groove defined therein for a slide movably received between the two frames. An inverted T-shaped connecting member is connected between the connecting member and the auxiliary desk wherein the connecting member is rotatably connected to the slide so that the auxiliary desk is slid and pivoted relative to the main desk.

3 Claims, 6 Drawing Sheets

DEVICE FOR CONNECTING AN AUXILIARY DESK TO A MAIN DESK

FIELD OF THE INVENTION

The present invention relates to a device for slidably and pivotably connecting an auxiliary desk to a main desk.

BACKGROUND OF THE INVENTION

A large amount of work needs to be dealt with on desks so that the desk in a modern office is required to have a larger surface to support more documents and office facilities thereon. However, in most of the offices, space is limited and additional office facilities are continuously developed so that a larger desk is not welcomed. In order to have enough desk surface, an L-shaped desk is developed so that the user does not need to move a long distance and he/she can use the larger desk surface. Such desks with a special configuration are expensive and are generally for persons having a higher rank so that the problems still exist.

The present invention intends to provide a device for connecting an auxiliary desk to the main desk, whereby the auxiliary desk can be slid and pivoted relative to the main desk. The auxiliary desk can be retracted into underside of the main desk when not in use.

SUMMARY OF THE INVENTION

In accordance with one aspect of the present invention, there is provided a device for connecting an auxiliary desk to a main desk and comprising two frames fixedly connected to the underside of the main desk and each of the frames having a groove defined therein for a slide movably received therebetween by the wheels of the slide moving in the grooves. The slide has a hole defined therethrough so that a connecting member is rotatably extending through the hole. The connecting member is connected to the auxiliary desk. Two rollers are connected to the connecting member and movably contacting the underside of the frames so that the auxiliary desk can be pulled along the two frames stably.

The object of the present invention is to provide a device having a simple structure which connects the auxiliary desk to the main desk so that the auxiliary desk can be moved and pivoted relative to the main desk.

Further features of the present invention will become apparent after a careful reading of the detailed description with appropriate reference to the accompanying drawings.

DETAILED DESCRIPTION OF THE PREFERRED EMBODIMENTS

Figure 1:
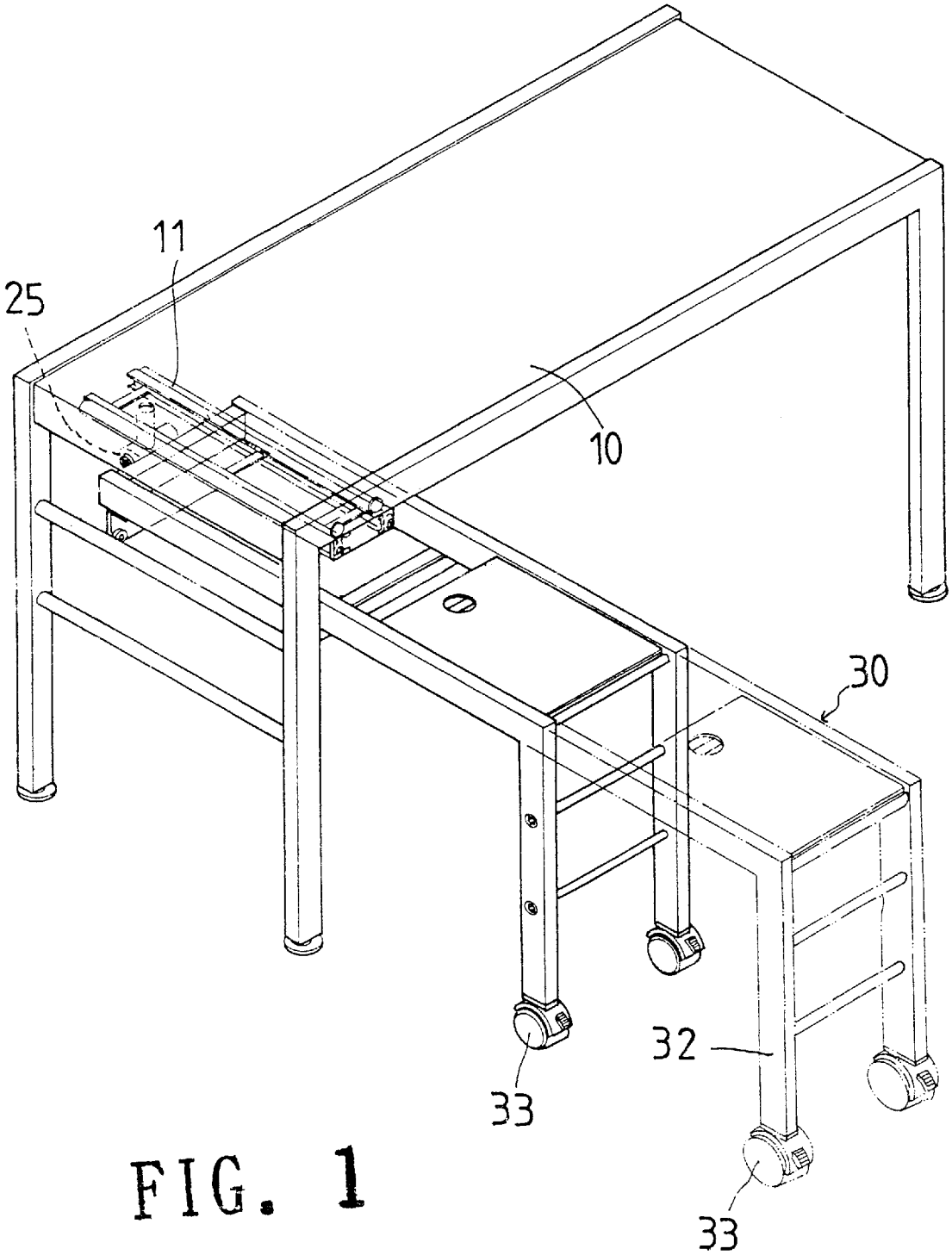
FIG. 1 is a perspective view of the main desk and the auxiliary desk which is connected to the main desk by the device in accordance with the present invention.
Figure 2:
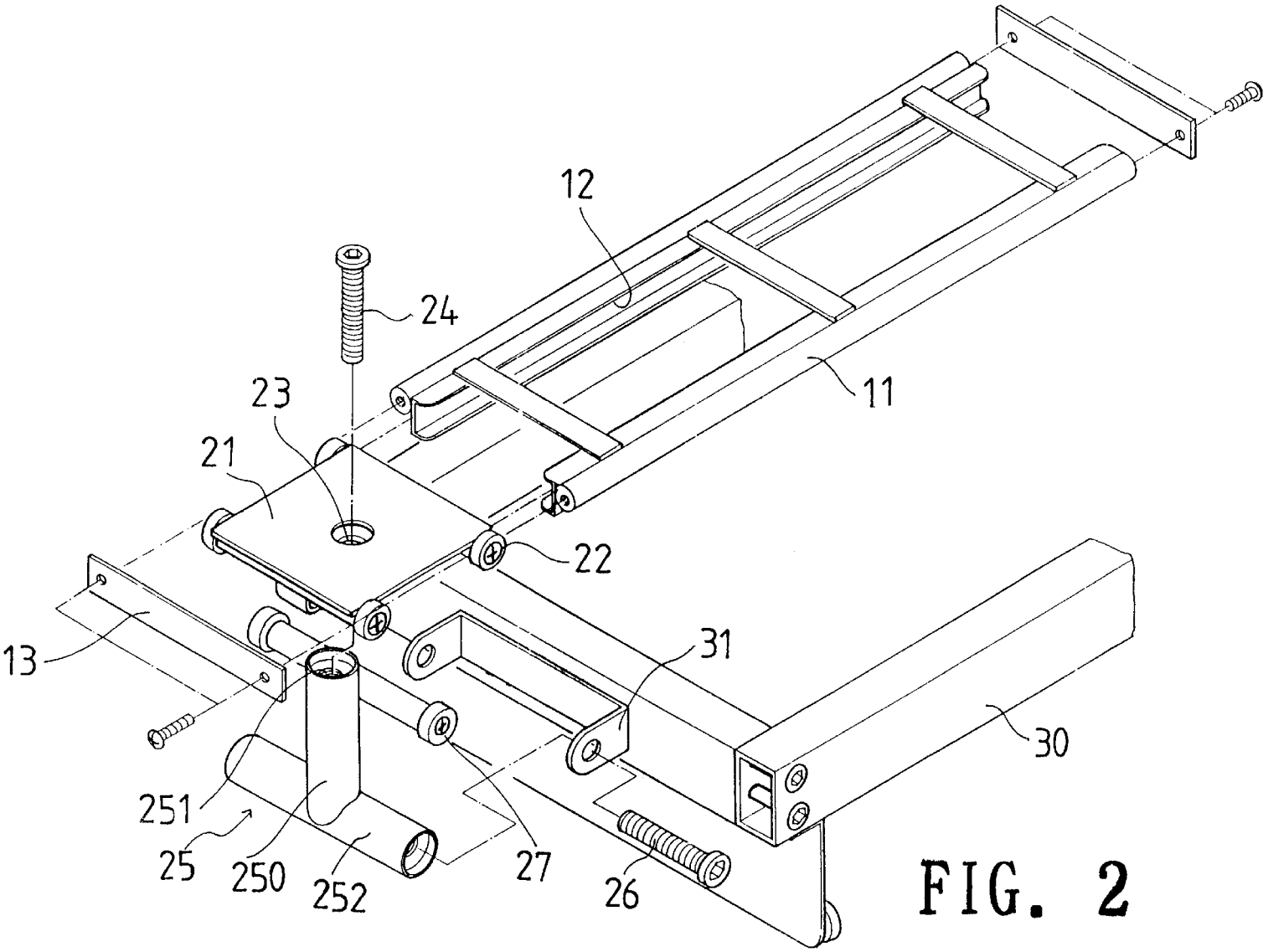
FIG. 2 is an exploded view of the device in accordance with the present invention.
Figure 3:
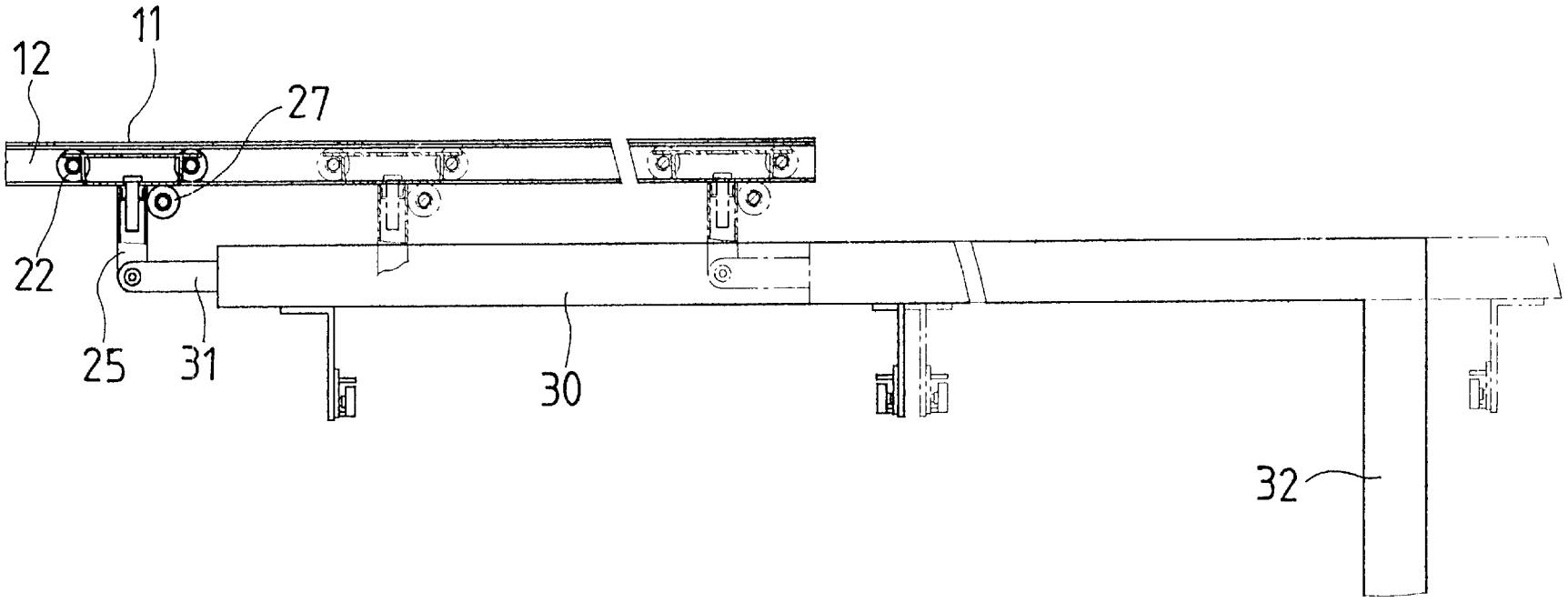
FIG. 3 is an illustrative view to show the device of the present invention and the auxiliary desk.
Figure 4:
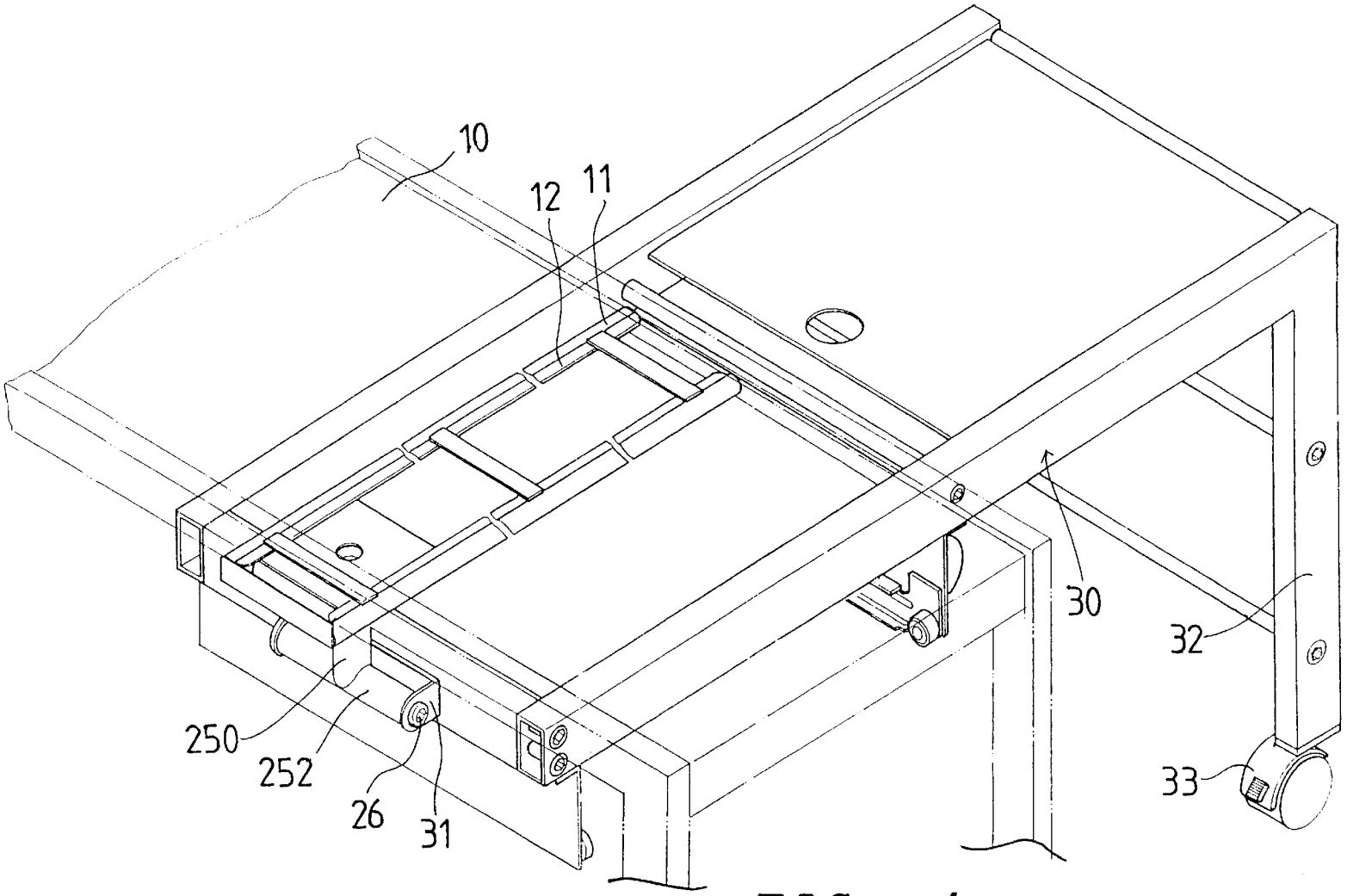
FIG. 4 is an enlarged view to show the device of the present invention, the auxiliary desk and the main desk.

Referring to FIGS. 1 to 4, the device for connecting an auxiliary desk 30 to a main desk 10 comprises two frames 11 which are fixedly attached to the underside of the main desk 10 and each of the frames 11 is connected to a U-shaped member having a groove 12 defined therein. A slide 21 has four wheels 22 connected to four corners thereof and the wheels 22 are movably received in the two grooves 12 so that the slide 21 can be moved along the two frames 11 by the wheels 22 moving, in the grooves 12. The slide 21 has a hole 23 defined therethrough. Two end plates 13 are respectively connected to the two ends of the two frames 11 so as to close the two grooves 12 such that the slide 21 will not be slid over the two grooves 12.

An inverted T-shaped connecting member 25 has its vertical portion 250 rotatably extending through the hole 23 of the slide 21 by a bolt 24 extending through the hole 23 and threadedly engaged in the threaded hole 251 defined in the vertical portion 250. The horizontal portion 252 has two threaded holes defined in its two ends thereof. The auxiliary desk 30 has two lugs 31 extending from one of two ends thereof so that the horizontal portion 252 is fixedly connected between the two lugs 31 by two bolts 26 extending through the two lugs 31 and engaged with the two threaded holes of the horizontal portion 252. The other end of the auxiliary desk 30 has two legs 32 extending therefrom and each of the two legs 32 has a wheel 33 rotatably connected thereto.

Figure 5:
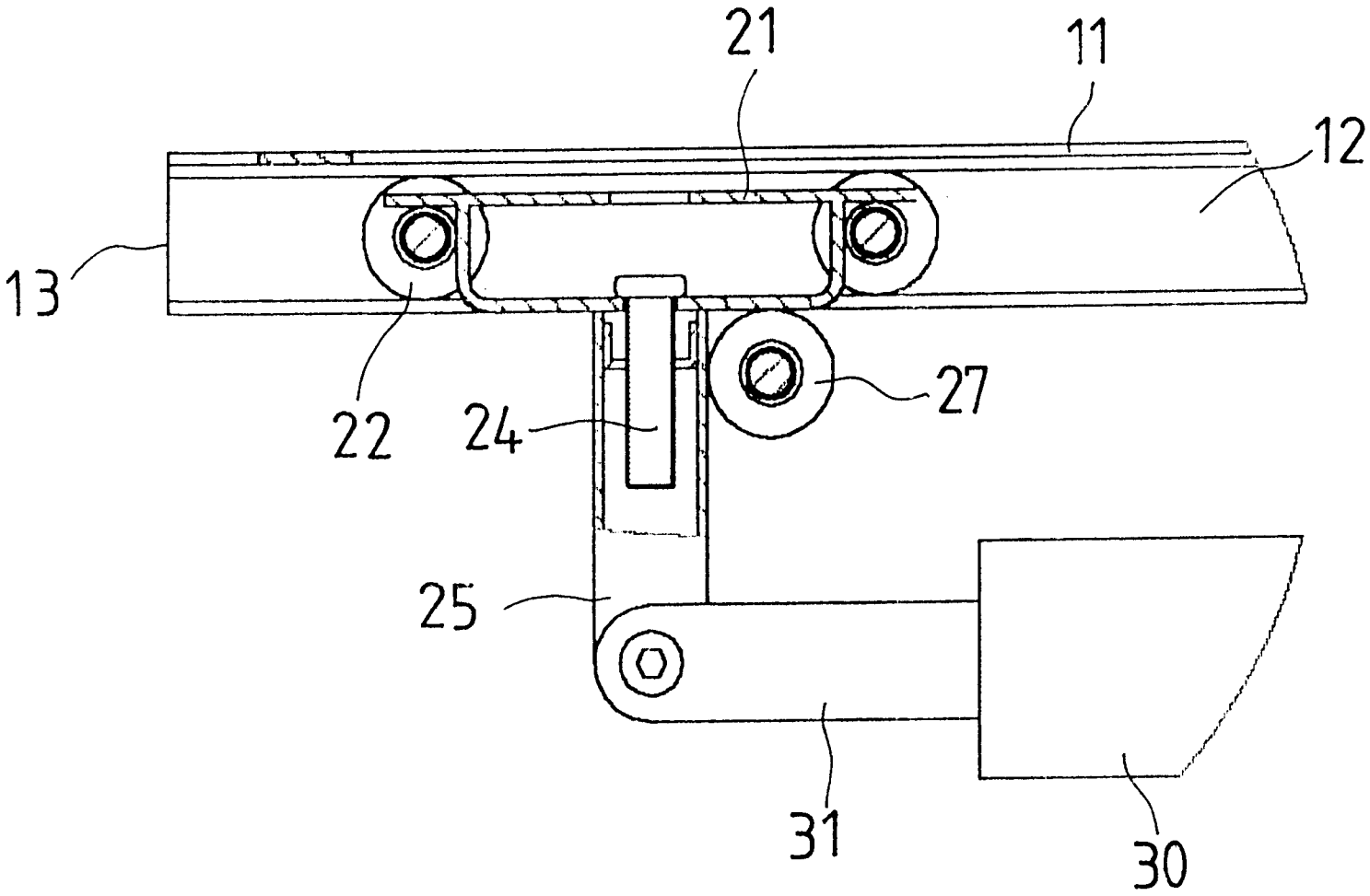
FIG. 5 is a side elevational view, partly in section, of the engagement of the device of the present invention, the two frames and the auxiliary desk.
Figure 6:
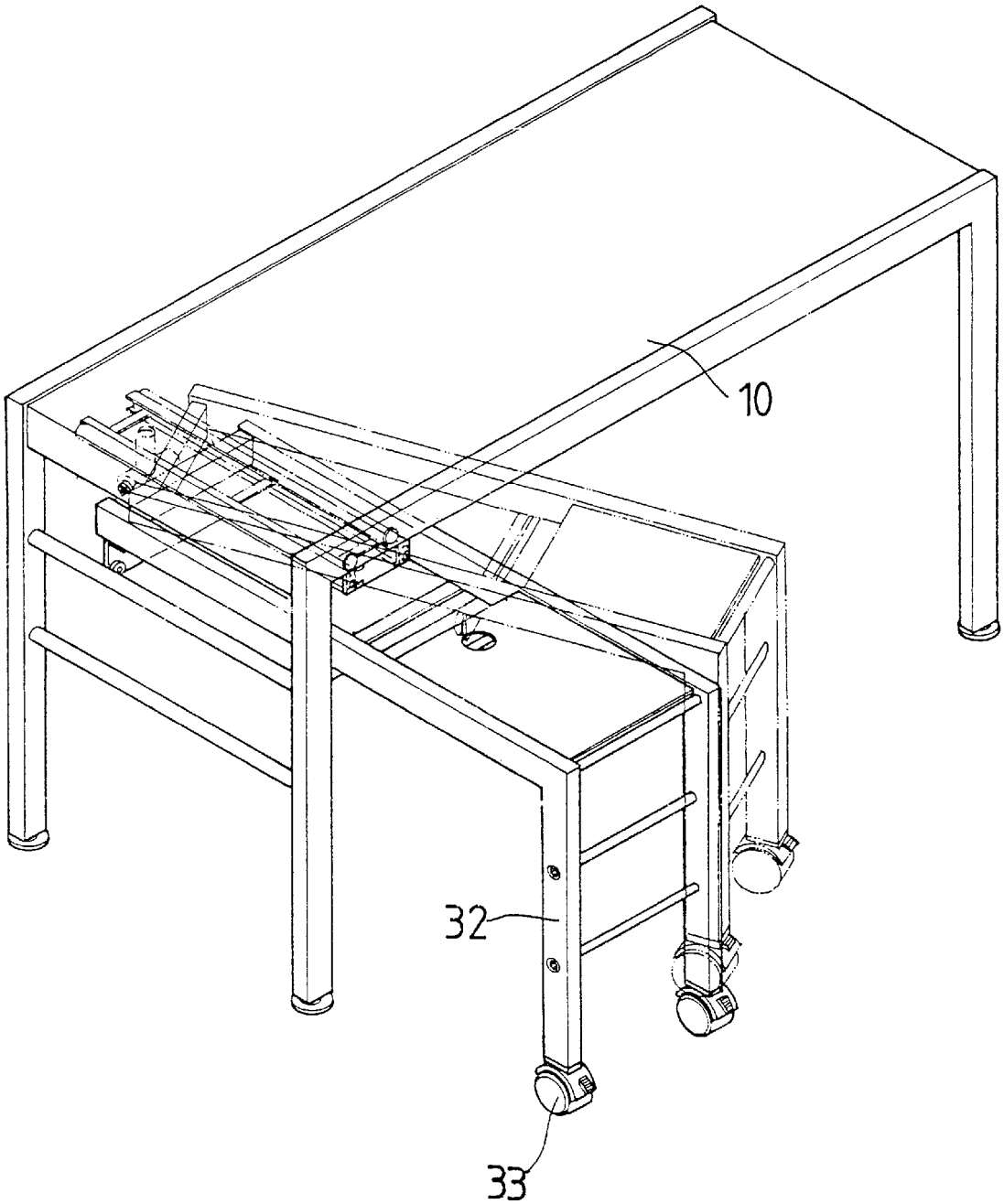
FIG. 6 is a perspective view to illustrate the auxiliary desk is pivoted relative to the main desk.

Referring to FIG. 5, a shaft has two rollers 27 connected to the two ends thereof and is connected to the vertical portion 250 of the connecting member 25 so that the two rollers movably contacts the underside of the frames 11. Accordingly, the auxiliary desk 30 can be pulled stably without shaking.

Accordingly, the auxiliary desk 30 can be conveniently received in the main desk 10 and stably pulled out from the main desk 10.

It should be clear to those skilled in the art that further embodiments may be made without departing from the scope and spirit of the present invention.

What is claimed is:

1. A device for connecting an auxiliary desk to a main desk, comprising:

two frames adapted to be fixedly attached to the underside of the main desk and each of said frames having a groove defined therein;

a slide having a plurality of wheels connected thereto which are movably received in said two grooves, said slide having a hole defined therethrough;

a connecting member rotatably extending through said hole of said slide and being adapted to be connected to the auxiliary desk, and two rollers connected to said connecting member and movably contacting the underside of said frames.

2. The device as claimed in claim 1, wherein said connecting member is an inverted T-shaped member.

3. The device as claimed in claim 1 further comprising two end plates connected to the two ends of said two frames to close said two grooves.

* * * * *